US007967609B2

(12) United States Patent
Capece et al.

(10) Patent No.: US 7,967,609 B2
(45) Date of Patent: Jun. 28, 2011

(54) SYSTEM FOR CONNECTING APPLIANCES TO WALL OUTLETS

(75) Inventors: Gregory V. Capece, Lebanon, NJ (US); Dana C. Hajedemos, Cheshire, CT (US); Michael R. Harm, Colts Neck, NJ (US); Nicholas Rocha, Vero Beach, FL (US)

(73) Assignee: Plug Away, Inc., Bethlehem, PA (US)

( * ) Notice: Subject to any disclaimer, the term of this patent is extended or adjusted under 35 U.S.C. 154(b) by 29 days.

(21) Appl. No.: 12/556,222

(22) Filed: Sep. 9, 2009

(65) Prior Publication Data

US 2011/0059623 A1 Mar. 10, 2011

(51) Int. Cl.
*H01R 11/30* (2006.01)

(52) U.S. Cl. ..... 439/39

(58) Field of Classification Search ..... 439/38–40
See application file for complete search history.

(56) References Cited

U.S. PATENT DOCUMENTS

| | | | | |
|---|---|---|---|---|
| 3,034,084 | A * | 5/1962 | Schmier et al. | 439/105 |
| 3,181,895 | A | 5/1965 | Cator | |
| 3,363,214 | A * | 1/1968 | Wright | 439/39 |
| 3,521,216 | A * | 7/1970 | Tolegian | 439/39 |
| 3,628,211 | A | 12/1971 | Fukuba | |
| 3,651,443 | A | 3/1972 | Quilez | |
| 3,808,577 | A | 4/1974 | Mathauser | |
| 4,038,625 | A | 7/1977 | Tompkins et al. | |
| 4,773,866 | A | 9/1988 | Basques | |
| 5,102,345 | A | 4/1992 | Stanwick et al. | |
| 5,803,751 | A | 9/1998 | Liu | |
| 5,931,683 | A | 8/1999 | Pinel | |
| 5,941,729 | A | 8/1999 | Sri-Jayantha | |
| 5,944,542 | A | 8/1999 | Lee | |
| 5,954,520 | A | 9/1999 | Schmidt | |
| 6,213,783 | B1 | 4/2001 | Kankkunen | |
| 6,283,767 | B1 | 9/2001 | Sornes | |

(Continued)

FOREIGN PATENT DOCUMENTS

EP 1815788 A1 8/2007

(Continued)

OTHER PUBLICATIONS

"The Maglet—A New Electrical Outlet for the Elderly", Adam Euerby et al., Proceedings of the Fourth IASTED International Conference, Telehealth and Assistive Technologies, Apr. 16-18, 2008, Baltimore, MD, USA, pp. 78-80.

*Primary Examiner* — Ross N Gushi
(74) *Attorney, Agent, or Firm* — RatnerPrestia

(57) ABSTRACT

Systems and adaptors for electrical connection of appliances are disclosed. An electrical connection includes an appliance adaptor having an appliance adaptor body, conducting members, and at least one magnet, and a wall adaptor having a wall adaptor body, conducting prongs, conducting rings, a spring member, and at least one magnet. The electrical connection system has an uncoupled state in which the at least one appliance adaptor magnet does not magnetically couple with the at least one wall adaptor magnet, the conducting members do not electrically contact the conducting rings, and the conducting rings do not electrically contact the conducting prongs. The electrical connection system also has a coupled state in which the at least one appliance adaptor magnet magnetically couples with the at least one wall adaptor magnet, the conducting members electrically contact the conducting rings, and the conducting rings electrically contact the conducting prongs.

19 Claims, 11 Drawing Sheets

U.S. PATENT DOCUMENTS

| | | | |
|---|---|---|---|
| 6,331,117 | B1 | 12/2001 | Brundage |
| 6,371,769 | B1 | 4/2002 | Brady |
| 6,464,509 | B1 | 10/2002 | Emberty et al. |
| 6,568,942 | B2 | 5/2003 | Lau et al. |
| 6,623,276 | B2 | 9/2003 | Dalmau Ferrerfabrega et al. |
| 6,638,076 | B2 | 10/2003 | Wang |
| 7,066,739 | B2 | 6/2006 | McLeish |
| 7,498,546 | B2 | 3/2009 | Belongia et al. |

FOREIGN PATENT DOCUMENTS

| | | |
|---|---|---|
| GB | 2414603 | 11/2005 |
| KR | 2004-0036047 A | 8/2004 |

* cited by examiner

SYSTEM FOR CONNECTING APPLIANCES TO WALL OUTLETS

FIELD OF THE INVENTION

The present invention relates generally to an electrical connection system, and more particularly to a system for connecting electrical appliances to wall outlets.

BACKGROUND OF THE INVENTION

Many appliances for use in the home and business require connection to an alternating current (AC) power supply. These appliances may connect to a suitable power supply using a plug. An appliance plug may include one or more prongs, pins, or other conducting protrusions for mating with a power supply. These prongs may often include a specific configuration to ensure proper mating with a corresponding power supply outlet.

Where the power supply outlet is mounted to the wall of a structure, the appliance plugs may require a measure of manual dexterity for the positioning and insertion of the appliance plugs in the wall outlet. Means for enabling the connection of appliance plugs to wall outlets that require less manual dexterity are desirable.

SUMMARY OF THE INVENTION

Aspects of the present invention include systems and adaptors for electrical connection of appliances. In one aspect of the present invention, an appliance adaptor includes an appliance adaptor body, two or more conducting members, and at least one magnet. Each of the two or more conducting members comprises a conducting receptacle and a conducting pin, the conducting receptacle being open in a first axial direction and configured to receive a prong of an appliance, the conducting pin being formed integrally with the conducting receptacle and extending through the appliance adaptor body in a second axial direction opposite the first axial direction. The at least one magnet is coupled to the appliance adaptor body and is oriented to provide a magnetic attraction in the first axial direction.

In another aspect of the present invention, a wall adaptor includes a wall adaptor body, two or more conducting prongs, two or more conducting rings, a spring member, and at least one magnet. The two or more conducting prongs are coupled to the wall adaptor body. The two or more conducting prongs extend from the wall adaptor body in an axial direction and are configured for insertion into a wall outlet. The two or more conducting rings are concentric around a line extending in the axial direction. The spring member is coupled to the wall adaptor body and the two or more conducting rings. The spring member is configured to bias the two or more conducting rings in the axial direction such that when the spring member is uncompressed, the two or more conducting rings do not electrically contact the two or more conducting prongs, and when the spring member is compressed, the two or more conducting rings electrically contact the two or more conducting prongs. The at least one magnet is coupled to the wall adaptor body. The at least one magnet is oriented to provide a magnetic attraction in the axial direction.

In yet another aspect of the present invention, an electrical connection includes an appliance adaptor having two or more conducting members extending through the appliance adaptor and at least one appliance adaptor magnet. The electrical connection system further includes a wall adaptor having two or more concentric conducting rings, two or more conducting prongs, and at least one wall adaptor magnet configured to magnetically couple with the at least one appliance adaptor magnet. The electrical connection system has an uncoupled state in which the at least one appliance adaptor magnet does not magnetically couple with the at least one wall adaptor magnet, the two or more conducting members do not electrically contact the two or more conducting rings, and the two or more conducting rings do not electrically contact the two or more conducting prongs. The electrical connection system also has a coupled state in which the at least one appliance adaptor magnet magnetically couples with the at least one wall adaptor magnet, the two or more conducting members electrically contact the two or more conducting rings, and the two or more conducting rings electrically contact the two or more conducting prongs.

BRIEF DESCRIPTION OF THE DRAWINGS

The invention is best understood from the following detailed description when read in connection with the accompanying drawing. Included in the drawing are the following figures.

DETAILED DESCRIPTION OF THE INVENTION

Although the invention is illustrated and described herein with reference to specific embodiments, the invention is not intended to be limited to the details shown. Rather, various modifications may be made in the details within the scope and range of equivalents of the claims and without departing from the invention.

The invention is best understood from the following detailed description when read in connection with the accompanying drawing figures, which shows exemplary embodiments of the invention selected for illustrative purposes. The invention will be described with reference to the figures. Such figures are intended to be illustrative rather than limiting and are included herewith to facilitate the explanation of the present invention.

Figure 1B:
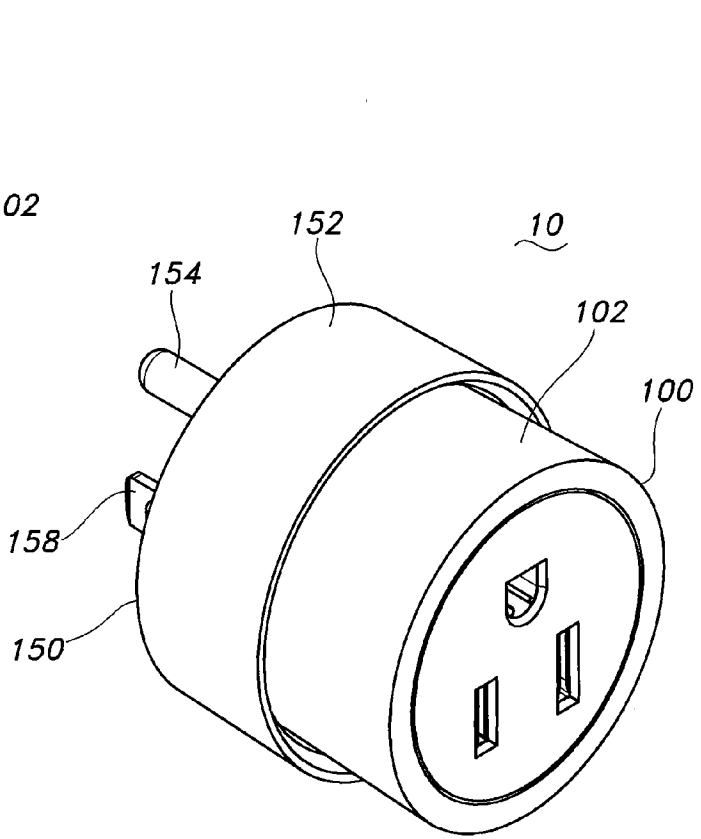
FIGS. 1A and 1B show perspective views of an embodiment of an electrical connection system in accordance with an aspect of the present invention.
Figure 1A:
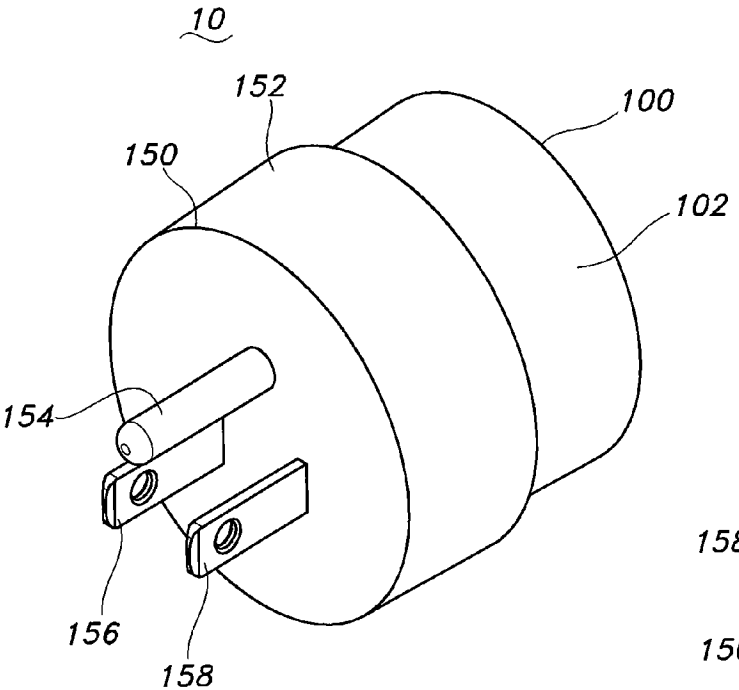

As an overview, FIGS. 1A and 1B show an embodiment of an electrical connection system, generally referenced by the numeral 10, in accordance with an aspect of the present invention. Broadly, electrical connection system 10 includes appliance adaptor 100 and wall adaptor 150. Electrical connection system 10 has a coupled state, in which appliance adaptor 100 and wall adaptor 150 are coupled to each other, and an uncoupled state, in which appliance adaptor 100 and wall adaptor 150 are separated from each other. In FIGS. 1A and 1B, electrical connection system 10 is illustrated in the coupled state. Additional details of electrical connection system 10 will be provided herein.

Appliance adaptor 100 receives the prongs of an appliance. In an exemplary embodiment, appliance adaptor 100 includes appliance adaptor body 102 and slots 104, 106, 108 for receiving three prongs of an alternating current (AC) plug from an electrical appliance. The number and orientation of slots in appliance adaptor 100 is illustrative and not limiting. Appliance adaptor 100 may include any number and orientation of slots to correspond to the plug from any appliance. Appliance prongs may be inserted into appliance adaptor 100 before, during, or after the coupling of appliance adaptor 100 with wall adaptor 150.

Wall adaptor 150 connects to a wall outlet. In an exemplary embodiment, wall adaptor 150 includes wall adaptor body 152 and prongs 154, 156, 158 for insertion into an AC wall outlet. The number and orientation of prongs on wall adaptor 150 is illustrative and not limiting. Wall adaptor 150 may include any number and orientation of prongs to correspond to any wall outlet. Wall adaptor 150 may be inserted into a wall outlet before, during, or after the coupling of appliance adaptor 100 with wall adaptor 150.

In the coupled state, the prongs of an appliance inserted in slots 104, 106, 108 of appliance adaptor 100 electrically contact with the prongs 154, 156, 158 of wall adaptor 150. If wall adaptor 150 is inserted in a wall outlet, then the appliance prongs may make electrical contact with the wall outlet, thereby completing an electrical circuit between the wall outlet and the electrical appliance.

In the uncoupled state, appliance prongs may remain inserted in appliance adaptor 100, such that appliance adaptor 100 remains in place on the end of the AC plug from the electrical appliance. Additionally, wall adaptor 150 may remain inserted in the wall outlet.

Appliance adaptor 100 and wall adaptor 150 are held in the coupled state through magnetic attraction, as will be further described herein. Appliance adaptor 100 and wall adaptor 150 may be uncoupled by providing sufficient force to overcome the magnetic attraction. In an exemplary embodiment, the magnetic force coupling appliance adaptor 100 and wall adaptor 150 may be optimized such that appliance adaptor 100 and wall adaptor 150 may be easily pulled apart by a user FIGS. 2-8 show an appliance adaptor 100 in accordance with an aspect of the present invention. Appliance adaptor 100 includes appliance adaptor body 102; slots 104, 106, 108; receptacles 114, 116, 118; pins 124, 126, 128; and magnets 140. Additional details of appliance adaptor 100 will be provided herein.

Appliance adaptor body 102 supports the components of appliance adaptor 100. In an exemplary embodiment, appliance adaptor body 102 includes a cylindrical outer surface and two end surfaces. One end surface of appliance adaptor body 102 may comprise an appliance end, and the other end surface of appliance adaptor body 102 may comprise a mating end. Appliance adaptor body 102 may be formed from any suitable non-conductive material or combination of materials. Suitable materials for appliance adaptor body 102 include polymer materials or fire-retardant materials such as, for example, fire retardant polycarbonate. Appliance adaptor body 102 may be formed from any suitable method including, for example, injection molding or insert molding.

Figure 2:
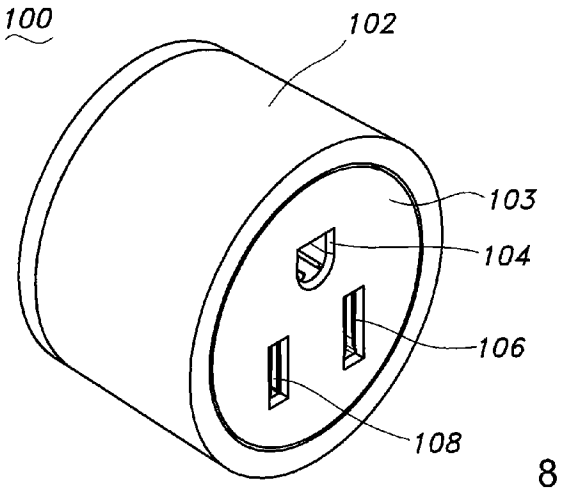
FIG. 2 shows a perspective view of an appliance adaptor of the electrical connection system of FIG. 1.
Figure 3:
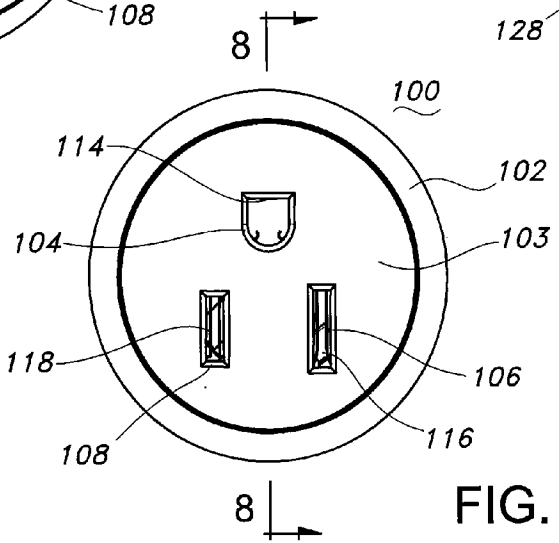
FIG. 3 shows an appliance end view of the appliance adaptor of the electrical connection system of FIG. 1.
Figure 7:
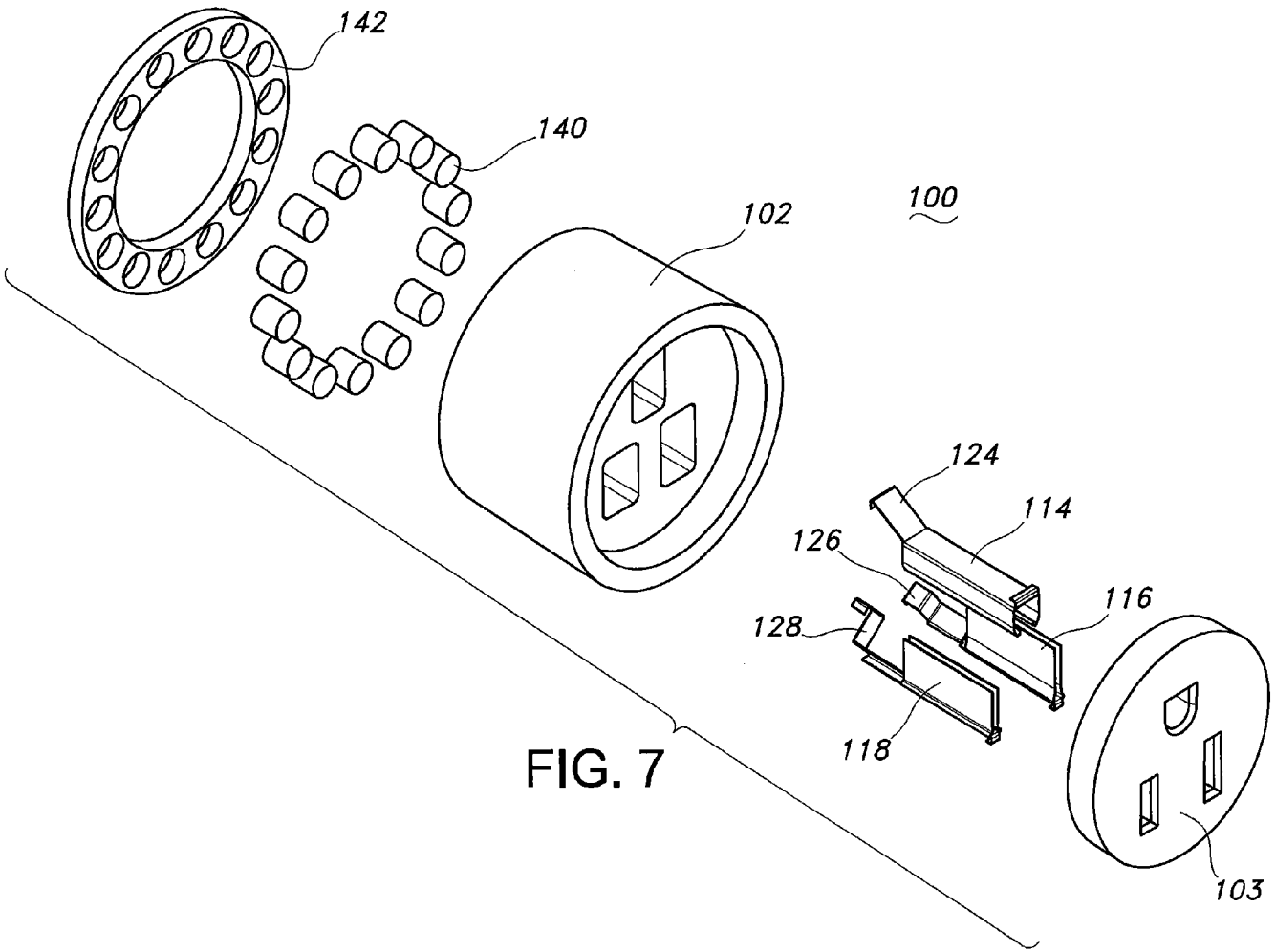
FIG. 7 shows an exploded perspective view of the appliance adaptor of the electrical connection system of FIG. 1.

FIGS. 2 and 3 show an appliance end of appliance adaptor 100. Slots 104, 106, 108 receive the prongs from an electrical appliance. In an exemplary embodiment, slots 104, 106, 108 are formed in slotted face 103. Slotted face 103 may be formed from the same materials as appliance adaptor body 102. As illustrated in FIGS. 2-3 and 7, slotted face 103 may be formed separately from appliance body 102. Alternatively, slotted face 103 may be integrally formed with appliance adaptor body 102. As illustrated in FIGS. 2 and 3, slots 104, 106, 108 may be oriented such that slot 104 corresponds to a ground prong of the appliance, slot 106 corresponds to the neutral prong of an appliance, and slot 108 corresponds to the live prong of an appliance. However, as explained above, the number and orientation of slots 104, 106, 108 in slotted face 103 is illustrative and not limiting. Appliance adaptor 100 may include any number and orientation of slots to correspond to the plug from any appliance.

Receptacles 114, 116, 118 electrically contact the prongs of the appliance that are inserted into slots 104, 106, and 108. In an exemplary embodiment, each receptacle 114, 116, 118 is positioned to receive a prong of the appliance that has been inserted through a respective slot 104, 106, 108. Receptacles 114, 116, 118 may extend axially though appliance adaptor body 102 in order to accommodate the length of the prongs of the appliance. For example, receptacles 114, 116, 118 may have dimensions to match the width and length of the prongs from a conventional AC plug from an electrical appliance. As illustrated in FIGS. 2 and 3, receptacles 114, 116, 118 may be oriented such that receptacle 114 receives the ground prong of the appliance, receptacle 116 receives the neutral prong of an appliance, and receptacle 118 receives the live prong of an appliance. As illustrated in FIG. 7, receptacles 114, 116, 118 may be formed separately from appliance adaptor body 102 and slotted face 103. Alternatively, receptacles 114, 116, 118 may be fixedly molded with appliance adaptor body 102 and/or slotted face 103 during an injection molding process. Receptacles 114, 116, 118 may be formed from any suitable conductive material or combination of materials. Suitable materials for receptacles 114, 116, 118 include highly conductive metals including, for example, brass or nickel-plated copper.

Figure 4:
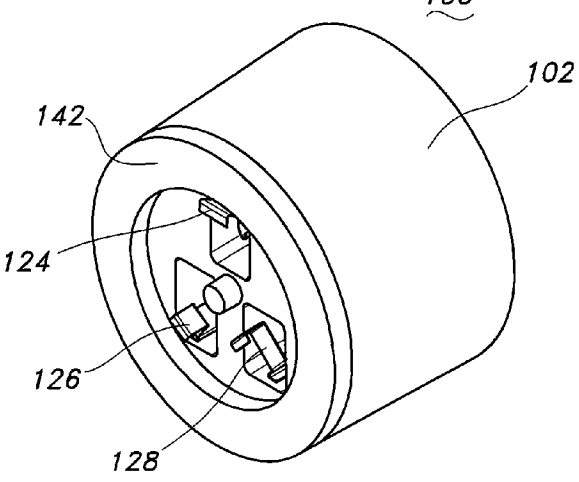
FIG. 4 shows another perspective view of the appliance adaptor of the electrical connection system of FIG. 1.
Figure 5A:
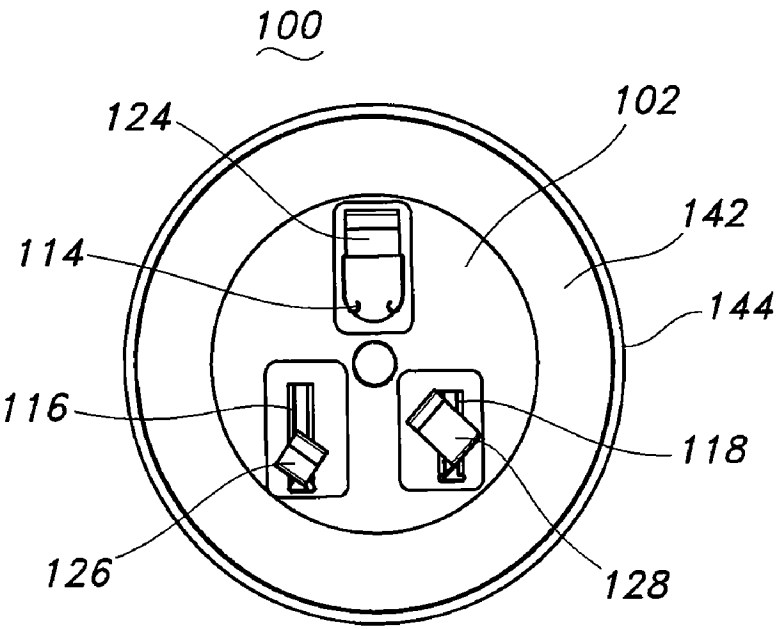
FIGS. 5A and 5B show a mating end view of the appliance adaptor of the electrical connection system of FIG. 1.
Figure 5B:
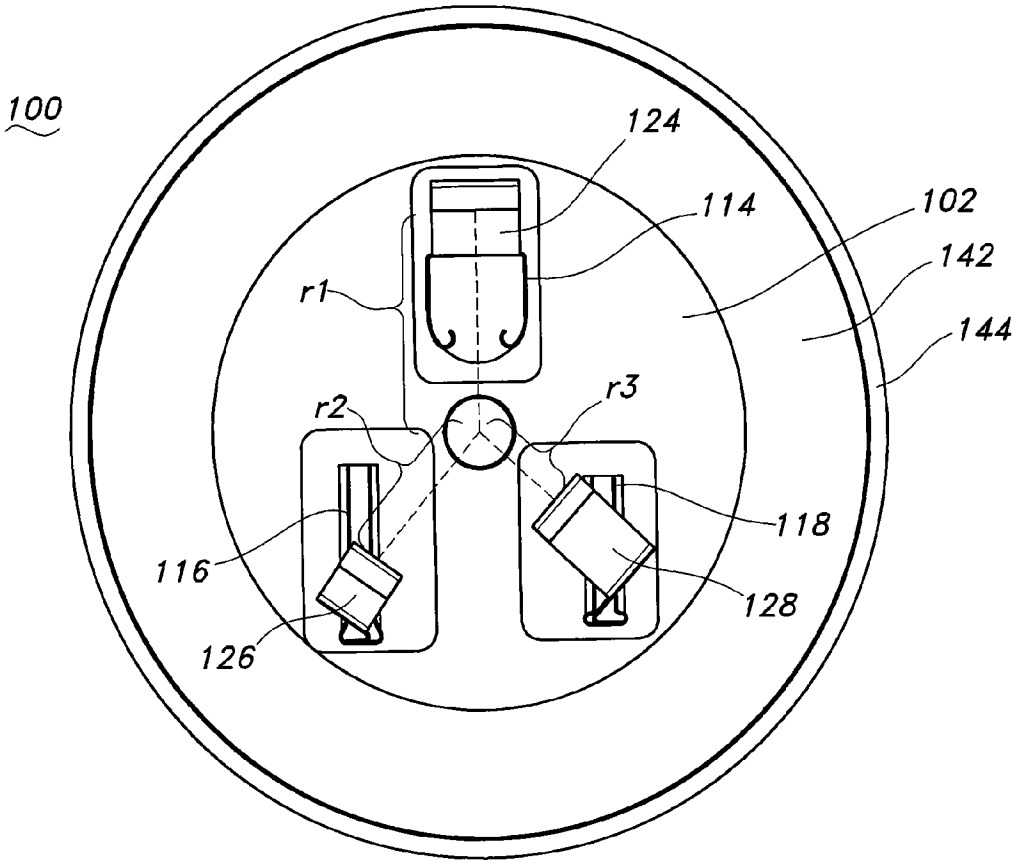

FIGS. 4-5B show a mating end of the appliance adaptor 100. Pins 124, 126, 128 electrically contact the receptacles 114, 116, 118. In an exemplary embodiment, pins 124, 126, 128 protrude beyond the mating end of appliance adaptor body 102. As illustrated in FIGS. 5A-5B, pins 124, 126, 128 may be oriented such that pin 124 corresponds to the ground prong of the appliance, pin 126 corresponds to the neutral prong of an appliance, and pin 128 corresponds to the live prong of an appliance. As illustrated in FIG. 5B, pins 124, 126, 128 may each protrude from appliance adaptor body 102 at a different radial distance from the axial center of appliance adaptor body 102. For example, pin 124 may protrude at a distance "r1" from the axial center, pin 126 may protrude at a distance "r2" from the axial center, and pin 128 may protrude at a distance "r3" from the axial center. The protruding ends of each pin 124, 126, 128 may include a bent portion for optimizing electrical contact with wall adaptor 150.

Figure 6B:
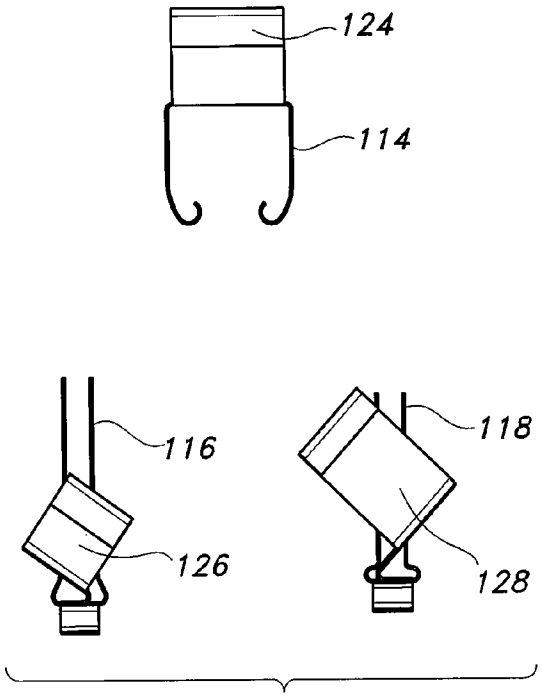
FIGS. 6A and 6B show enlarged perspective and end views of conducting member components of the appliance adaptor of the electrical connection system of FIG. 1.
Figure 6A:
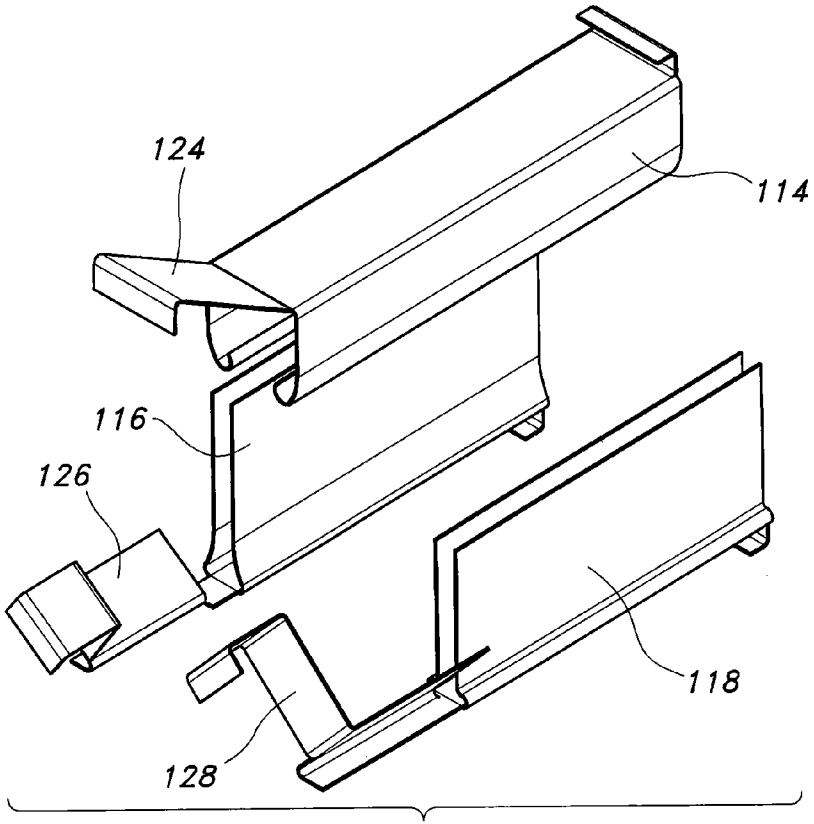

FIGS. 6A and 6B show the receptacles and pins of appliance adaptor 100. In an exemplary embodiment, each pin 124, 126, 128 may be formed integrally with a respective receptacle 114, 116, 118 to create singular conducting members. Forming receptacles 114, 116, 118 integrally with pins 124, 126, 128 into singular conducting members may be desirable for the purposes of manufacturing and for improving electric contact between respective receptacles and pins. Alternatively, pins 124, 126, 128 may be separately formed from receptacles 114, 116, 118. As illustrated in FIG. 7, pins 124, 126, 128 may be formed separately from appliance adaptor body 102. Alternatively, pins 124, 126, 128 may be fixedly molded with appliance adaptor body 102 during an injection molding process. Pins 124, 126, 128 may be formed from any suitable conductive material or combination or materials. Suitable materials for pins 124, 126, 128 include highly conductive metals including, for example, brass or nickel-plated copper.

FIG. 7 shows an exploded view of appliance adaptor 100. Magnets 140 provide a magnetic force for coupling appliance adaptor 100 with wall adaptor 150. In an exemplary embodiment, magnets 140 are coupled to appliance adaptor body 102 using magnet holder 142. Magnet holder 142 may be formed from the same materials as appliance adaptor body 102. Magnet holder 142 may include a tapered edge 144 (illustrated in FIGS. 5A and 5B) to promote mating of appliance adaptor 100 with wall adaptor 150. As illustrated in FIG. 7, magnet holder 142 may be formed separately from appliance adaptor body 102. Alternatively, magnet holder 142 may be integrally formed with appliance adaptor body 102. Magnets 140 may be oriented to provide a magnetic attraction in the axial direction of appliance adaptor body 102.

As illustrated in FIG. 7, magnets 140 may comprise a plurality of magnets arranged circumferentially around the mating end of appliance adaptor body 102. However, the number and shape of magnets 140 is illustrative and not limiting. Appliance adaptor 100 may include any number, shape, and configuration of magnets in order to magnetically couple with wall adaptor 150. For example, magnet 140 could be one or more annular magnetic rings coupled to the mating end of appliance adaptor body 102. Magnets 140 may be formed from any suitable magnetic materials or combination of materials such as, for example, neodymium or other rare earth metals.

Figure 8:
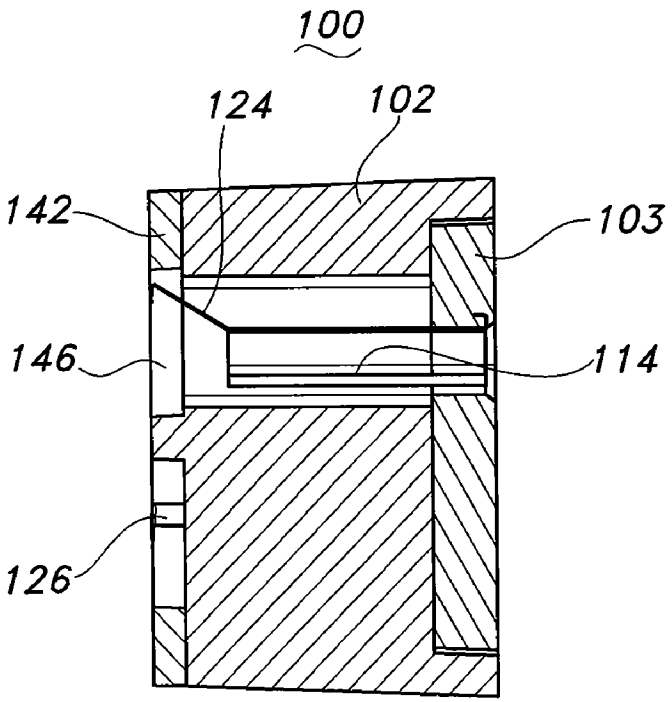
FIG. 8 shows a cross-sectional side view of the appliance adaptor of the electrical connection system of FIG. 1.

The use of appliance adaptor 100 will be described herein with reference to FIGS. 7 and 8. FIG. 8 shows a cross-sectional view of appliance adaptor 100 through line 8-8 in FIG. 3. In an exemplary embodiment, a three-prong AC plug of an electric appliance may be inserted into slots 104, 106, 108 in slotted face 103. When inserted, the ground prong of the appliance plug is received in receptacle 114, the neutral prong of the appliance plug is received in receptacle 116, and the live prong of the appliance plug is received in receptacle 118. Thereby, prongs electrically contact with receptacles 114, 116, 118, which in turn electrically contact with pins 124, 126, 128. Accordingly, pin 124 forms an electrical contact with the ground prong, pin 126 electrically contacts with the neutral prong, and pin 128 electrically contacts with the live prong.

Pins 124, 126, 128 extend through appliance adaptor body 102. As illustrated in FIG. 8, pins 124, 126, and 128 protrude from the mating end of appliance adaptor body 102. Where magnet holder 142 also protrudes from the mating end of appliance adaptor body 102, a concavity 146 is optionally formed for enabling contact with pins 124, 126, 128. Magnets 140 may be oriented to attract wall adaptor 150 such that corresponding portions of wall adaptor 150 form electrical contacts with pins 124, 126, 128, as will be described below. The end of each pin 124, 126, 128 may include a bent portion to provide a larger surface area for contacting a corresponding portion of wall adaptor 150.

FIGS. 9-16 show a wall adaptor 150 in accordance with an aspect of the present invention. Wall adaptor 150 includes wall adaptor body 152, prongs 154, 156, 158, conducting rings 164, 166, 168, ring holder 180, spring member 182, and magnets 190. Additional details of wall adaptor 150 will be provided herein.

Wall adaptor body 152 supports the components of wall adaptor 150. In an exemplary embodiment, wall adaptor body 152 includes a hollow cylindrical portion including an open end and a substantially closed end. The open end of wall adaptor body 152 may comprise a mating end. The hollow cylindrical portion may thus be sized to receive the cylindrical outer surface of appliance adaptor 100. The substantially closed end of wall adaptor body 152 may comprise a wall end for mounting to a wall outlet. Wall adaptor body 152 may be formed from the same materials as appliance adaptor body 102. Wall adaptor body 152 may be formed from any suitable method including, for example, injection molding or insert molding.

Figure 10:
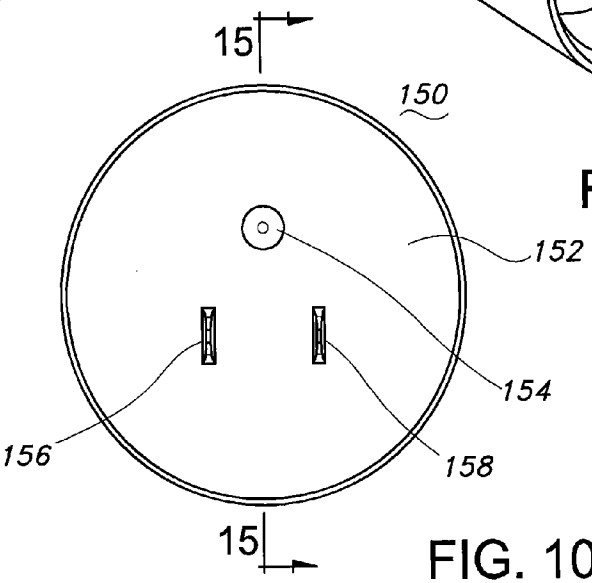
FIG. 10 shows a wall end view of the wall adaptor of the electrical connection system of FIG. 1.
Figure 9:
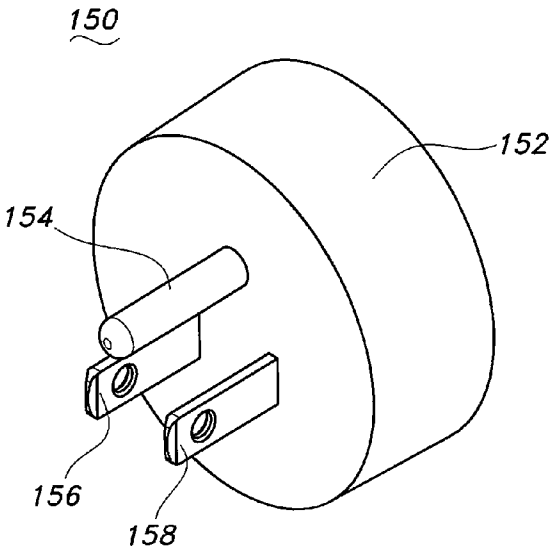
FIG. 9 shows a perspective view of a wall adaptor of the electrical connection system of FIG. 1.
Figure 14:
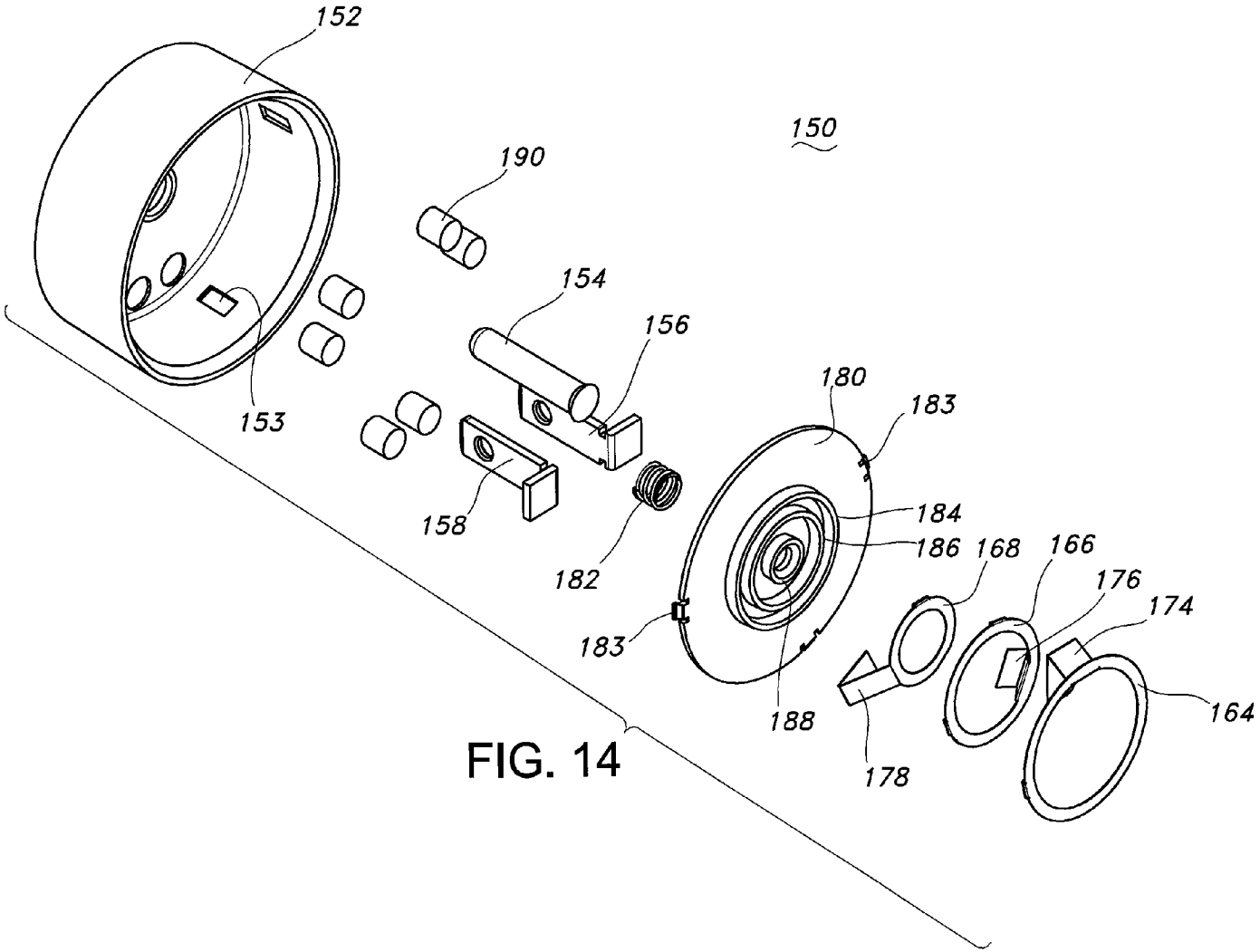
FIG. 14 shows an exploded perspective view of the wall adaptor of the electrical connection system of FIG. 1.

FIGS. 9 and 10 show a wall end of wall adaptor 150. Prongs 154, 156, 158 are inserted in a wall outlet. In an exemplary embodiment, prongs 154, 156, 158 protrude from the wall end of wall adaptor 150. As illustrated in FIG. 14, prongs 154, 156, 158 may be formed separately from wall adaptor body 152. If formed separately, prongs 154, 156, 158 may be fixed to a surface of wall adaptor body 152 or inserted through slots in wall adaptor body 152. Alternatively, prongs 154, 156, 158 may be fixedly molded with wall adaptor body 152. As illustrated in FIGS. 9 and 10, prongs 154, 156, 158 may be oriented such that prong 154 is a ground prong, prong 156 is a neutral prong, and prong 158 is a live prong for insertion in a conventional three-prong AC wall outlet. However, as explained above, the number and orientation of prongs 154, 156, 158 on wall adaptor body 152 is illustrative and not limiting. Wall adaptor 150 may include any number and orientation of prongs to correspond to any wall outlet. Prongs 154, 156, 158 may be formed from any suitable conductive material or combination of materials. Suitable materials for prongs 154, 156, 158 include highly conductive metals including, for example, brass or nickel-plated copper.

Figure 11:
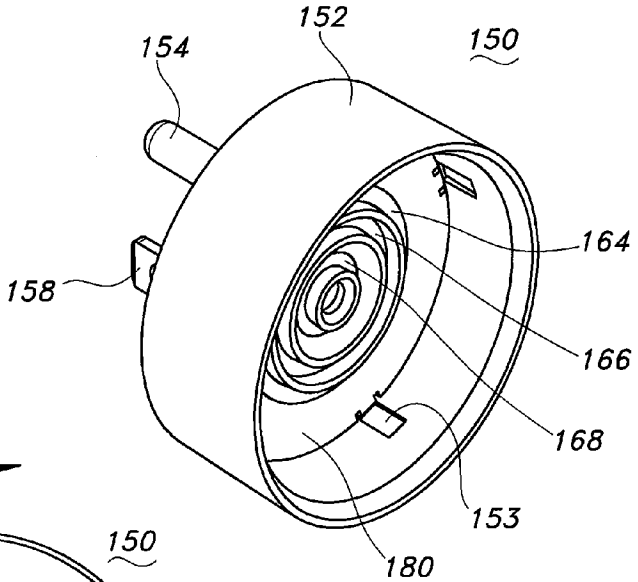
FIG. 11 shows another perspective view of the wall adaptor of the electrical connection system of FIG. 1.
Figure 12:
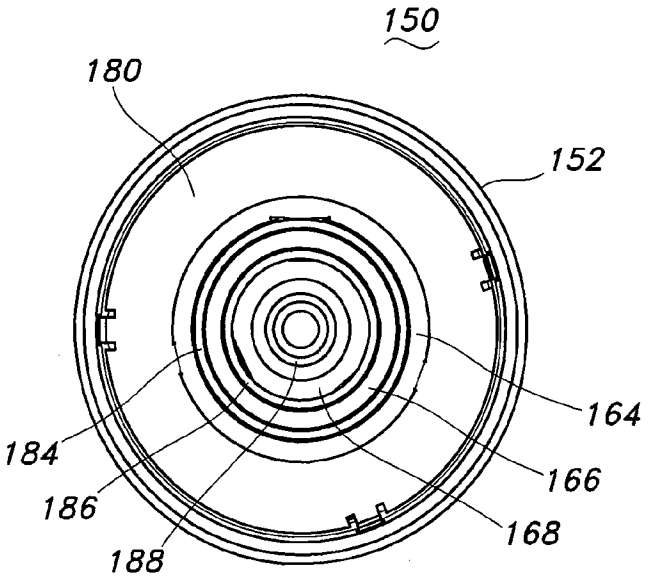
FIG. 12 shows a mating end view of the wall adaptor of the electrical connection system of FIG. 1.

FIGS. 11 and 12 show a mating end of wall adaptor 150. Conducting rings 164, 166, 168 electrically contact the pins 124, 126, 128 in the coupled state of electrical system 10. In an exemplary embodiment, each conducting ring 164, 166, 168 is positioned to contact a respective pin 124, 126, 128 of the appliance adaptor when the appliance adaptor 100 is coupled with the wall adaptor 150.

Conducting rings 164, 166, 168 may be arranged coaxially within wall adaptor body 152. Conducting rings may each have a different diameter, such that the different radii of conducting rings 164, 166, 168 correspond to the different radial distances of respective pins 124, 126, 128 from the center of appliance adaptor body 102. For example, in the coupled state of electrical connection system 10, the contact portion of pin 124 may electrically contact outer ring 164, the contact portion of pin 126 may electrically contact middle ring 166, and the contact portion of pin 128 may electrically contact inner ring 168. Conducting rings 164, 166, 168 may be formed from any suitable conductive material or combination of materials. Suitable materials for conducting rings 164, 166, 168 include highly conductive metals including, for example, brass or nickel-plated copper.

Figure 13A:
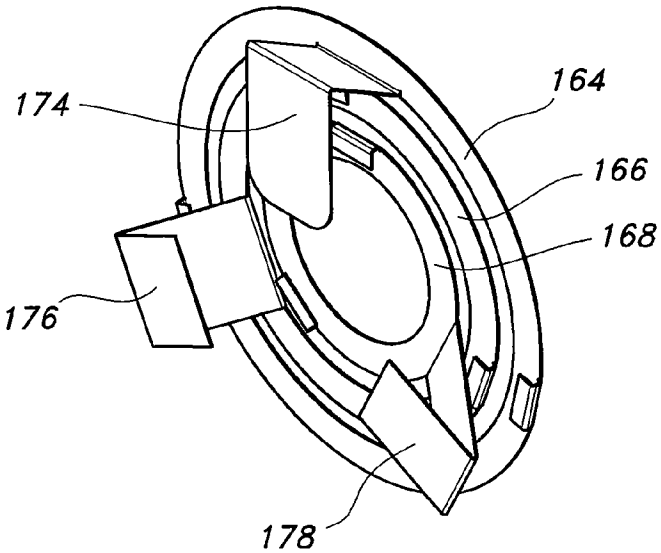
FIGS. 13A and 13B show enlarged views of conducting rings and tabs of the wall adaptor of the electrical connection system of FIG. 1.
Figure 13B:
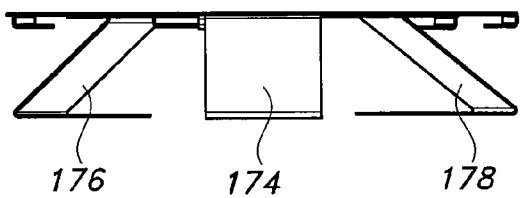

FIGS. 13A and 13B show the conducting rings and tabs of wall adaptor 150. As illustrated in FIGS. 13A-14, each one of conducting rings 164, 166, 168 electrically contacts a tab 174, 176, 178. In an exemplary embodiment, tabs 174, 176, 178 extend from conducting rings 164, 166, 168 toward the wall end of wall adaptor 150. Tabs 174, 176, 178 may be oriented such that tab 174 corresponds to the ground prong 154 of the wall adaptor 150, tab 176 corresponds to the neutral prong 156 of the wall adaptor 150, and tab 178 corresponds to the live prong 158 of wall adaptor 150. The ends of each tab 174, 176, 178 may include a bent portion for optimizing electrical contact with prongs 154, 156, 158.

As illustrated in FIG. 13B, each tab 174, 176, 178 extends the same axial distance "d" from rings 164, 166, 168. However, tabs 174, 176, 178 may each axially extend away from conducting rings 164, 166, 168 different axial distances. For example, tab 174 may extend a farthest axial distance, tab 176 may extend a middle axial distance, and tab 178 may extend a shortest axial distance from conducting rings 164, 166, 168. As illustrated in FIG. 12, tabs 174, 176, 178 may be formed integrally with conducting rings 164, 166, 168. Alternatively, tabs 174, 176, 178 may be separated formed and affixed to conducting rings 164, 166, 168. Tabs 174, 176, 178 may be formed from any suitable conductive material or combination or materials. Suitable materials for tabs 174, 176, 178 include highly conductive metals including, for example, brass or nickel-plated copper.

FIG. 14 shows an exploded view of wall adaptor 100. Ring holder 180 holds conducting rings 164, 166, 168. In an exemplary embodiment, conducting rings 164, 166, 168 are coaxially mounted on a surface of ring holder 180 facing the mating end of wall adaptor 150. Ring holder 180 may include slots for passage of tabs 174, 176, 178 from conducting rings 164, 166, 168 toward the wall end of wall adaptor 150. As illustrated in FIG. 14, conducting rings 164, 166, 168 and tabs 174, 176, 178 may be formed separately from ring holder 180. Alternatively, conducting rings 164, 166, 168 and tabs 174, 176, 178 may be fixedly molded with appliance adaptor body 102 during an injection molding process. Ring holder 180 may further include annular ridges 184, 186, 188.

As illustrated in FIGS. 10 and 11, conducting rings 164, 166, 168 may be mounted to ring holder 180 such that ridges 184, 186 separate the conducting rings. In this configuration, conducting rings 164, 166, 168 may be seated within recesses formed by ridges 184, 186, 188. Ridges 184, 186, 188 may serve to guide pins 124, 126, 128 into contact with conducting rings 164, 166, 168 when appliance adaptor 100 is coupled with wall adaptor 150. Ring holder 180 may be formed from the same materials as wall adaptor body 152. Ring holder 180 may be formed from any suitable method including, for example, injection molding.

Spring member 182 is coupled to ring holder 180. In an exemplary embodiment, spring member 182 biases ring holder 180 away from the wall end of wall adaptor 150. Spring member 182 is mounted at one end to the wall end of wall adaptor body 152 and at the other end to ring holder 180. Spring member 182 may further be mounted to the middle of ring holder 180. Spring member 182 may comprise one or multiple springs compressible in an axial direction within wall adaptor body 152. However, it is contemplated that spring member 182 may comprise any mechanical component that biases ring holder 180 within wall adaptor body 152 in the axial direction.

To facilitate movement of ring holder 180 in conjunction with spring member 182, ring holder 180 may include one or more tabs 183 that may be inserted into grooves 153 in wall adaptor body 152, as illustrated in FIGS. 11 and 14. Tabs 183 may be configured to move within grooves 153 as ring holder 180 moves in the axial direction, thereby maintaining the orientation of ring holder 180.

Magnets 190 provide a magnetic force for coupling wall adaptor 150 with appliance adaptor 100. In an exemplary embodiment, magnets 190 are coupled to the wall end of wall adaptor body 152. Magnets 190 may be oriented to provide a magnetic attraction in the axial direction of wall adaptor body 152. As illustrated in FIG. 14, magnets 190 may comprise a plurality of magnets arranged circumferentially around the inside of the wall end of wall adaptor body 152. However, the number and shape of magnets 190 is illustrative and not limiting.

Wall adaptor 150 may include any number, shape, and configuration of magnets in order to magnetically couple with appliance adaptor 100. For example, magnets 190 could be one or more annular magnetic rings coupled to the insider of the wall end of wall adaptor body 152. Magnets 190 may be formed from any suitable magnetic materials or combination of materials such as, for example, neodymium or other rare earth metals.

Figure 15:
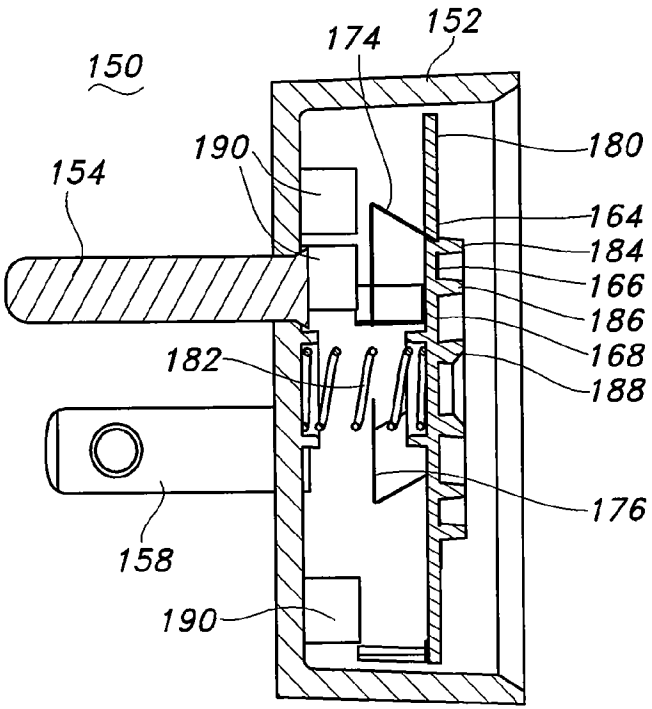
FIG. 15 shows a cross-sectional side view of the wall adaptor of the electrical connection system of FIG. 1, in an uncoupled state.

The use of wall adaptor 150 will be described herein with reference to FIGS. 14-16. FIG. 15 shows a cross-sectional view of wall adaptor 150 through line 15-15 in FIG. 10. Prongs 154, 156, 158 of wall adaptor 150 may be inserted into a standard three-prong AC wall outlet. As illustrated in FIG. 15, spring member 182 is uncompressed and biases ring holder 180 away from the wall end of wall adaptor 150. Spring member 182 may be uncompressed when wall adaptor 150 is uncoupled to appliance adaptor 100.

When spring member 182 is uncompressed, tabs 174, 176, 178 of conducting rings 164, 166, 168 do not axially extend all the way to the wall end of wall adaptor body 152. Accordingly, there is no electrical contact between tabs 174, 176, 178 and prongs 154, 156, 158. The lack of electrical contact between conducting rings 164, 166, 168 and prongs 154, 156, 158 when wall adaptor 150 is uncoupled to appliance adaptor 100 may be desirable to prevent conducting rings 164, 166, 168 from being connected to live current from the wall outlet while exposed to the open end of wall adaptor body 152.

Figure 16:
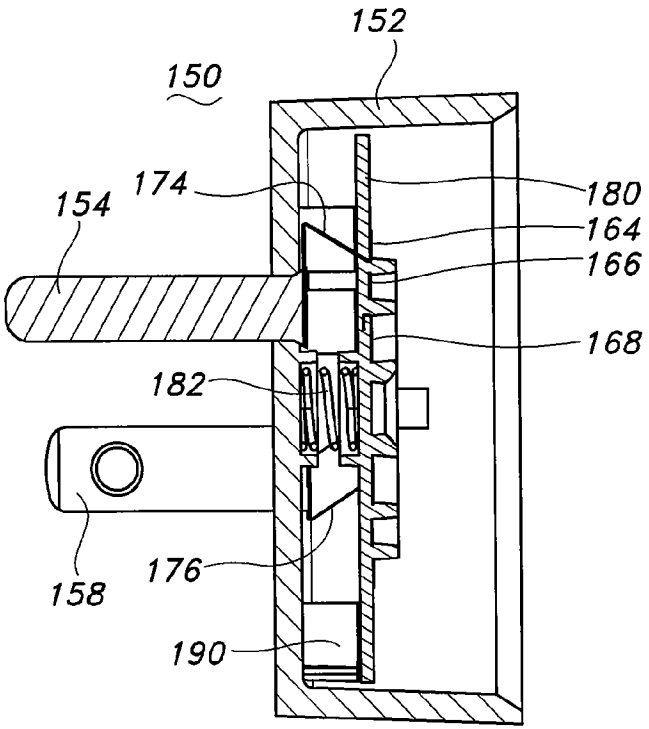
FIG. 16 shows another cross-sectional side view of the wall adaptor of the electrical connection system of FIG. 1, in a coupled state.

FIG. 16 shows another cross-sectional view of wall adaptor 150. As illustrated in FIG. 16, spring member 182 is compressed and does not bias ring holder 180 away from the wall end of wall adaptor 150. Spring member 182 may be compressed when wall adaptor 150 is coupled to appliance adaptor 100. When spring member 182 is compressed, tabs 174, 176, 178 of conducting rings 164, 166, 168 axially extend all the way to the wall end of wall adaptor body 152. Accordingly, tab 174 contacts ground prong 154, tab 176 contacts neutral prong 176, and tab 178 contacts live prong 178.

Where tab 174 extends a farthest axial distance, tab 176 extends a middle axial distance, and tab 178 extends a shortest axial distance, as described above, contact with prongs 154, 156, 158 will be formed at different times. For example, as spring member 182 is compressed, tab 174 contacts ground prong 154 first, then tab 176 contacts neutral prong 156, then tab 178 contacts live prong 178. The order of connecting to ground prong 154, then neutral prong 156, then live prong 158 may be desirable to prevent possible short circuits that may arise, for example, if tab 178 and conducting ring 168 experience a live current from live prong 158 before conducting rings 164, 166 are connected.

When spring member 182 is fully compressed, an electrical contact is formed between ground prong 154 and outer ring 164, between neutral prong 156 and middle ring 166, and between live prong 158 and inner ring 168. Magnets 190 may be oriented to attract appliance adaptor 100 such that appliance adaptor body 102 is received within wall adaptor body 152.

Figure 17:
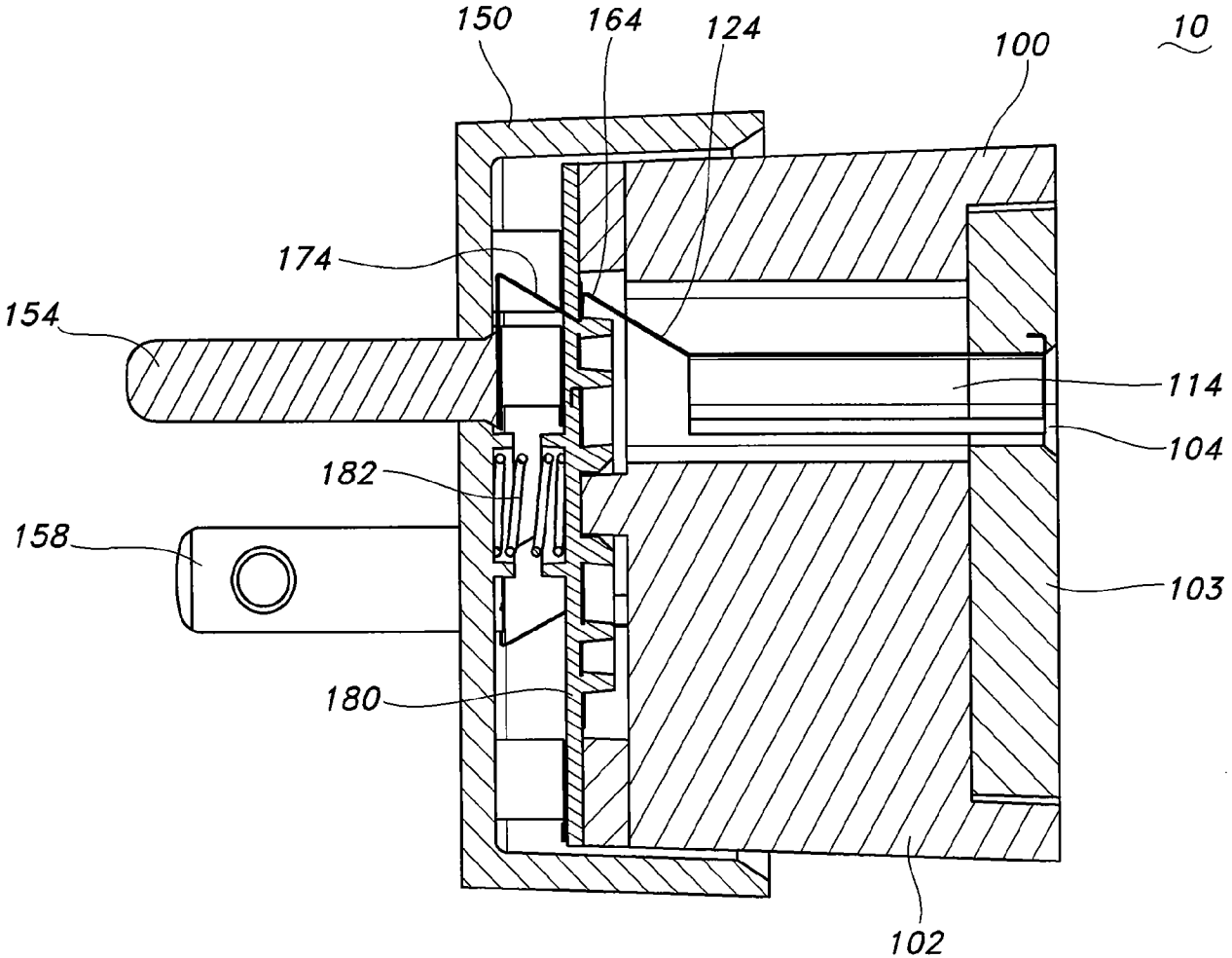
FIG. 17 shows a cross-section side view of the coupled electrical connection system of FIG. 1.

FIG. 17 shows a cross-sectional view of electrical system 10 in the coupled state. In an exemplary embodiment, when appliance adaptor 100 and wall adaptor 150 are coupled, pins 124, 126, 128 of appliance adaptor 100 may protrude into recesses created by ridges 184, 186, 188 and electrically contact conducting rings 164, 166, 168 of wall adaptor 150. Additionally, when coupled, spring member 182 is compressed, allowing tabs 174, 176, 178 to electrically contact prongs 154, 156, 158 of wall adaptor 150.

Thus, when coupled, the conducting components of appliance adaptor 100 and wall adaptor 150 form electrical contacts such that receptacle 114 contacts pin 124, which contacts conducting ring 164, which contacts tab 174, which contacts ground prong 154, such that each component is electrically connected to the others, as illustrated in FIG. 17. This is also true of the other respective receptacles, pins, conducting rings, tabs, and prongs. Where the prongs of an appliance cord are inserted into appliance adaptor 100, the electrical connection may extend between the appliance cord and the prongs 154, 156, 158 of wall adaptor 150, thus completing an electrical circuit with a wall outlet when wall adaptor 150 is inserted in the wall outlet.

Electrical connection system 10 enables an electrical circuit to be formed and broken between the appliance and the wall outlet by manipulating appliance adaptor 100 and wall adaptor 150. For example, the appliance plug may be inserted into the appliance end of appliance adaptor 100, and the wall adaptor 150 may be inserted into the wall outlet. The mating end of appliance adaptor 100 may then be positioned adjacent the mating end of wall adaptor 150. In this configuration, appliance adaptor magnets 140 and wall adaptor magnets 190 apply a mutually attractive magnetic force.

The applied magnetic force may be sufficient to cause appliance adaptor body 102 to be received within wall adaptor body 152. For example, magnets 140 and 190 may each collectively have a pull strength of 3.2 lbs. Similarly, spring member 182 of wall adaptor 150 may have a compressive force of 3.2 lbs. Thus, the attractive magnetic force between magnets 140 and 190 may be sufficient to compress spring member 182, as illustrated in FIG. 15. This attraction couples appliance adaptor 100 to wall adaptor 150, forming the electrical circuit described above between the appliance plug and the wall outlet.

To break the electrical circuit between the appliance plug and the wall outlet, a force may be applied to appliance adaptor 100 sufficient to overcome the magnetic attraction between appliance adaptor magnets 140 and wall adaptor magnets 190. The force may be applied directly to appliance adaptor 100, or may be applied to an appliance plug that has been inserted into appliance adaptor 100. If force is applied in this manner, it may be necessary that receptacles 114, 116, 118 of appliance adaptor 100 are shaped to provide sufficient friction to prongs of the appliance plug to withstand separation at the force necessary to overcome magnetic attraction.

When the force necessary to overcome magnetic attraction is applied to appliance adaptor 100, appliance adaptor 100 may uncouple from wall adaptor 150, thereby breaking an electrical contact between pins 124, 126, 128 and conducting rings 164, 166, 168. Further, when appliance adaptor 100 uncouples from wall adaptor 150, spring member 182 may uncompress, thereby breaking an electrical contact between tabs 174, 176, 178 and prongs 154, 156, 158.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

What is claimed:

1. An appliance adaptor of an electrical connection system utilizing magnetic coupling, the appliance adaptor comprising:

an appliance adaptor body;

two or more conducting members, each conducting member comprising a conducting receptacle and a conducting pin, the conducting receptacle being open in a first axial direction and configured to receive a prong of an appliance, the conducting pin being formed integrally with the conducting receptacle and extending through the appliance adaptor body in a second axial direction opposite the first axial direction; and at least one magnet coupled to the appliance adaptor body, the at least one magnet being oriented to provide a magnetic attraction in the first axial direction, wherein the appliance adaptor comprises a plurality of circumferentially-arranged magnets.

2. The appliance adaptor of claim 1, wherein the appliance adaptor body defines two or more slots, each slot being configured to receive a prong of the appliance.

3. The appliance adaptor of claim 1, the appliance adaptor comprising three conducting members.

4. The appliance adaptor of claim 1, wherein the at least one magnet comprises an annular magnetic ring.

5. A wall adaptor of an electrical connection system utilizing magnetic coupling, the wall adaptor comprising:

a wall adaptor body;

two or more conducting prongs coupled to the wall adaptor body, the two or more conducting prongs extending from the wall adaptor body in an axial direction and being configured for insertion into a wall outlet;

two or more conducting rings, the conducting rings being concentric around a line extending in the axial direction;

a spring member coupled to the wall adaptor body and the two or more conducting rings, the spring member being configured to bias the two or more conducting rings in the axial direction such that when the spring member is uncompressed, the two or more conducting rings do not electrically contact the two or more conducting prongs, and when the spring member is compressed, the two or more conducting rings electrically contact the two or more conducting prongs; and at least one magnet coupled to the wall adaptor body, the at least one magnet being oriented to provide a magnetic attraction in the axial direction.

6. The wall adaptor of claim 5, the wall adaptor comprising three conducting prongs and three conducting rings.

7. The wall adaptor of claim 5, further comprising a ring holder, the two or more conducting rings being affixed to the ring holder, and the ring holder being coupled to the spring member.

8. The wall adaptor of claim 7, wherein the two or more conducting rings are disposed in two or more annular recesses defined in the ring holder.

9. The wall adaptor of claim 7, wherein the spring member comprises two springs coupled to the ring holder.

10. The wall adaptor of claim 5, each of the conducting rings comprising a tab, wherein when the spring member is uncompressed, the tabs of the conducting rings do not electrically contact the conducting prongs, and when the spring member is compressed, the tabs of the conducting rings electrically contact the conducting prongs.

11. The wall adaptor of claim 10, wherein when the spring member is compressed the tabs electrically contact the conducting prongs sequentially.

12. The wall adaptor of claim 5, wherein the at least one magnet comprises a plurality of circumferentially-arranged magnets.

13. An electrical connection system utilizing magnetic coupling, the electrical connection system comprising:

an appliance adaptor having:

two or more conducting members extending through the appliance adaptor; and at least one appliance adaptor magnet;

a wall adaptor having:

two or more concentric conducting rings;

two or more conducting prongs; and at least one wall adaptor magnet configured to magnetically couple with the at least one appliance adaptor magnet, the electrical connection system having an uncoupled state in which the at least one appliance adaptor magnet does not magnetically couple with the at least one wall adaptor magnet, the two or more conducting members do not electrically contact the two or more conducting rings, and the two or more conducting rings do not electrically contact the two or more conducting prongs, and the electrical connection system having a coupled state in which the at least one appliance adaptor magnet magnetically couples with the at least one wall adaptor magnet, the two or more conducting members electrically contact the two or more conducting rings, and the two or more conducting rings electrically contact the two or more conducting prongs.

14. The electrical connection system of claim 13, wherein the two or more conducting members comprise two or more conducting pins.

15. The electrical connection system of claim 13, wherein the wall adaptor further comprises a spring member, the spring member being coupled to bias the two or more conducting rings.

16. The electrical connection system of claim 15, wherein the spring member is uncompressed in the uncoupled state of the electrical connection system and the spring member is compressed in the coupled state of the electrical connection system.

17. The electrical connection system of claim 16, wherein the appliance adaptor further comprises an appliance adaptor body, the wall adaptor further comprises a wall adaptor body, and wherein in the coupled state, the spring member is compressed between the appliance adaptor body and the wall adaptor body.

18. The electrical connection system of claim 13, wherein one of the at least one wall adaptor magnet and the at least one appliance adaptor magnet comprises a plurality of circumferentially-arranged magnets.

19. The electrical connection system of claim 13, wherein one of the at least one wall adaptor magnet and the at least one appliance adaptor magnet comprises an annular magnetic ring.

* * * * *